US005979375A

United States Patent [19]

Ballardini

[11] Patent Number: 5,979,375

[45] Date of Patent: Nov. 9, 1999

[54] RECIPROCATING INTERNAL COMBUSTION ENGINE, IN PARTICULAR FOR ACHIEVING HIGH PRESSURES, WITH MECHANICAL REGULATION FOR CONTROLLED DETONATION INHIBITION

[75] Inventor: Leopoldo Ballardini, Ravenna, Italy

[73] Assignee: Anna Giacobbi, Ravenna, Italy

[21] Appl. No.: 09/098,527

[22] Filed: Jun. 17, 1998

[30] Foreign Application Priority Data

Jun. 17, 1997 [IT] Italy ..... BO97A0369

[51] Int. Cl.[6] ..... F02B 75/32

[52] U.S. Cl. ..... 123/48 B; 123/197.4; 74/579 E

[58] Field of Search ..... 123/48 B, 78 E, 123/78 F, 197.1, 197.3, 197.4; 74/579 E

[56] References Cited

U.S. PATENT DOCUMENTS

| | | | |
|---|---|---|---|
| 423,515 | 3/1890 | Colborne | 123/197.1 |
| 1,141,658 | 6/1915 | Schmied | 123/78 F |
| 1,875,180 | 8/1932 | Rider | 123/78 E |
| 4,085,628 | 4/1978 | McWhorter | 123/197.3 |

FOREIGN PATENT DOCUMENTS

| | | | |
|---|---|---|---|
| 925964 | 9/1947 | France . | |
| 95240 | 8/1970 | France . | |
| 34 43 701 | 6/1986 | Germany | 123/197.3 |
| 25470 | 11/1910 | United Kingdom . | |
| 4482 | of 1911 | United Kingdom | 123/78 F |
| 477 016 | 3/1936 | United Kingdom . | |
| 2 251 455 | 7/1992 | United Kingdom | 123/48 B |
| 2 251 456 | 7/1992 | United Kingdom . | |

*Primary Examiner*—Willis R. Wolfe
*Assistant Examiner*—Brian Hairston
*Attorney, Agent, or Firm*—Young & Thompson

[57] ABSTRACT

An internal combustion engine comprising: a piston (2) and a cylinder (3), the piston (2) being sealedly mounted to the cylinder (3) and being reciprocally mobile therein between a Top Dead Center (TDC) and a Bottom Dead Center (BDC); also comprising a combustion chamber (4) delimited by the piston (2) and the cylinder (3); a crankshaft (5) provided with a crank (5*m*) pin (5*p*); a connecting rod (6) having a small end (6*p*) rotatably connected to the piston (2) and a big end (6*t*) rotatably connected to the pin (5*p*) of the crank (5*m*) of the crank shaft (5), also comprising at least one cam (7), mounted, rotatably and freely mobile on the big end (6*t*) of the connecting rod (6) and on the pin (5*p*) of the crank (5*m*), which cam (7) by effect of inertia consequent to a rotation of the crank (5*m*), moves cyclically rotatingly with respect to the pin (5*p*) and the connecting rod (6) between two operative positions, in which it transmits to the connecting rod (6) an action which adds to the inertia actions of the connecting rod (6) and the piston (2), and which in correspondence with reaching Top Dead Center enables a rapid displacement (70) of the connecting rod (6)-crank (5*m*) assembly towards the Bottom Dead Center, so as to prevent a series of conditions from occurring in the combustion chamber (4) which would lead to detonation of a fuel-air mixture due to an effect of an overpressure generated in said combustion chamber (4).

15 Claims, 4 Drawing Sheets

99
98
99
99
5m
75
97

11
5p
70
12
13
7
5a 10
9
13

40
1s 6
5
5m
75
99
97
98
7
5a
5p
13

RECIPROCATING INTERNAL COMBUSTION ENGINE, IN PARTICULAR FOR ACHIEVING HIGH PRESSURES, WITH MECHANICAL REGULATION FOR CONTROLLED DETONATION INHIBITION

DESCRIPTION

The invention relates to a reciprocating internal combustion engine with mechanical regulation for controlling and inhibiting detonation, in particular for achieving high pressures. In relation to the performance offered, the engine also provides lower consumption, greater power, better torque and a lower quantity of unburnt waste substances and toxic gases.

Reciprocating internal combustion engines are thermal motors converting the greatest possible portion of energy released by burning fuel within the engine itself into mechanical work.

The working fluid, which exchanges energy with the mobile engine organs through a process of expansion and compression, is constituted by a mixture of air and fuel before combustion and by products of the fuel oxidation in air after combustion.

By virtue of their simplicity, compactness and high power-to-weight ratio, these engines have been swiftly adapted for use in propelling vehicles, both land and water-borne, and even in some cases, air-borne; they have also been used for the generation of power in fixed and self-propelling work machines.

Reciprocating engines, as is well known, are generally provided with at least one piston which is sealedly and slidably mounted in a cylinder, in which the piston is reciprocable between a top dead centre and a bottom dead centre. The piston and the cylinder define in combination a combustion chamber, comprised between the upper end of the cylinder and a mobile wall—i.e. the upper surface of the piston—in which chamber, after the formation of the air-fuel mixture, an ignition takes place, causing combustion, expansion and discharge of the resulting exhaust gases.

There are two types of cycles which follow the above-described operative process: namely, the Diesel cycle and the Otto cycle, The engines carrying out one type of cycle and the engines carrying out the other type of cycle are considerably different in terms of functional characteristics and performance, which makes each preferable to the other in differing fields of use.

In particular, internal combustion engines of the Otto cycle type have a controlled ignition. In these engines, a petrol vapour-air mixture (though other lightweight fuel types can be used, liquid and/or gas) is ignited by a spark produced between the electrodes of a spark plug, leading to a very fast combustion (ideally at constant volume).

Diesel-cycle engines, on the other hand, have spontaneous ignition. Finely-atomized fuel is injected into compressed hot air, so as to cause self-ignition and give rise to a more gradual combustion, ideally at a constant pressure.

The expulsion of gases burnt in the previous cycle from the cylinder or cylinders of the engine and their substitution by the fresh fuel load, constitutes a fluid-dynamic operation which substantially influences engine performance.

Considering the ways in which the fuel mixture reload is achieved, the above-described engines can be separated into two kinds, four-stroke and two-stroke.

A comparison between Otto cycle and Diesel cycle engines brings some significant differences to light.

The first difference is constituted by a weight-to-power ratio, higher in Diesel than in Otto engines. This fact derives mainly from the higher compression ratios needed to bring the pressure and temperature of the air to sufficiently high levels in order to cause the fuel mixture to self-ignite when the fuel is injected into the cylinder.

The Diesel engine members have to be of such dimensions as to resist pressures which are nearly double in the compression and combustion stroke, and for this reason, they are heavier (when they are made of the same materials as a comparable Otto engine).

As the specific power (for unit of displacement) of a Diesel engine is considerably lower, this further increases the difference between the two types of engine, leading to an even greater weight-to-power ratio of the Diesel engine with respect to the Otto engine.

Furthermore, the relative slowness, even in the most modern fast Diesel engines, with which the combustion process is performed, even with the most modern and therefore advanced compression ratios, still prevent the Diesel engine from reaching high rotational speeds.

The specific power which can be developed per unit of displacement, then, is much lower than in controlled ignition engines having the same features, resulting in greater overall dimensions for a same power output.

Finally, it is worth mentioning the characteristic "roughness" of combustion of the Diesel engine, which tends to cause vibrations in the engine structure, making the engine noisier and leading to a more difficult and expensive installation.

The Diesel engine, however, has the advantage of a better thermal efficiency, as, notwithstanding the fact that the Otto cycle has the best thermal efficiency at equal compression ratios, with the Diesel engine higher compression ratios can be achieved (and are quite often required for a quick fuel ignition) than would be possible with an Otto engine with no danger of combustion anomalies.

Furthermore, Diesel engine performance diminishes less rapidly with a change in the fuel-air mixture to leaner, thanks to the regulation system that can be adopted in a Diesel. This regulation system allows to reduce the power developed by the engine by progressively increasing the air/fuel ratio, which makes the Diesel engine particularly suitable for applications which require the engine to operate in conditions of partial load.

A further advantage of the Diesel is that it uses fuels (diesel fuel, bio-diesel, fuel oil, etc.) which in themselves are less precious from the energetic point of view, as their refining requires a lower energy outlay. In some cases these fuels are even by-products of other processes, and in others are what can be termed alternative fuels.

This aspect, together with lower relative fuel consumption, contributes further to containing the costs of running a Diesel engine. Thus it is logical that this type of engine finds application in those sectors where engine running costs are prevalent with respect to problems connected with weight and size (industrial road transport, agricultural machines, earth-moving machines, railway and ship engines, as well as fixed power plants).

The Otto cycle engine, on the other hand, is especially suitable for the low-power field. Its typical application is in vehicles, mobile machines etc., where the most important criteria are: high specific output, lightness, small dimensions and smoothness of functioning.

The present invention concerns a new reciprocating internal combustion engine, which offers and improves the advantages of the Diesel engine and the Otto engine. both four- and two-stroke, while reducing the less positive aspects of both, conserving however all the most relevant technological mechanical, electronic and structural solutions of both. Also, the invention does not ignore the modern essential improvements of fluid-dynamic technology applied to each engine, from aspiration, to the cylinder, the combustion chamber, the discharge. The invention also offers normally aspirated, supercharged and turbo versions.

The general concept at the heart of the present invention is to operate onto the variables influencing ignition and maintenance of the chemical-physical combustion reaction by enhancing in particular the pressure and, albeit in a smaller measure, the temperature of the air-fuel mixture, up to values which are decidedly above those at present in existence.

This approach in known type engines would entail an insurmountable drawback consisting in the detonation or "knocking" phenomenon.

In known engines, especially Otto cycle engines, combustion occurs in a characteristic kinetic way wherein the flame is progressively propagated through a sheet of flame which irradiates, in a very short time, from the ignition start zone out towards the peripheral and coldest parts of the fluid mixture.

The chemical-physical combustion reaction requires a certain time in which to develop, often called the incubation period. This time lapse, in an engine rotating at thousands of r.p.m., can be measured in ten-thousandths of a second. Although this is indeed a very short time, the combustion reaction cannot be considered instantaneous with regard to the whole body of mixture, but it irradiates directionally, in those directions where the sheet of flame meets the air-fuel mixture having the characteristics most suitable for burning.

Since the duration of each physical event in the engine corresponds to a certain crank rotation angle, by expressing times as a function of that rotation angle it has been seen that to obtain maximum power in an aspirated engine, the maximum pressure in the combustion chamber must be reached in a condition in which the crank has passed the top dead centre by a certain rotation angle of the crankshaft. This means that the combustion must be at a very advanced stage when the above-described condition is reached. The residual quantity of mixture still unburnt will then contribute, when successfully burning, to maintaining the pressure sufficiently high during at least the first part of expansion.

Supposing to increase the volumetric compression ratio of the engine, with the increase of the pressure reached in the combustion chamber at the moment of mixture ignition, an increase in the temperature of the air-fuel mixture is also produced. The temperature increase in turn favours the increase in combustion reaction speed; thus, higher volumetric compression ratios require a smaller crank advance angle for correct and complete development of the reaction.

With reference to the above-described combustion process, the conditions leading to detonation would be closer together with the increase in volumetric compression ratio.

The detonation, commonly known as "knocking", is due also to the presence of pockets at a distance from the mixture ignition starting zone, which rather than participating in the combustion, behave as an explosive, exploding in sympathy. As a consequence of this, peaks of pressure and shocks are created, which rapidly cross the combustion chamber (at a speed sometimes higher than 1000 m/sec.), thus generating in certain operating conditions a characteristic noise, also known as knocking or pinging.

The above can occur for many reasons: an overlean mixture; a mixture containing badly-distributed pockets; an insufficient turbulence for uniformly homogenising the fuel within the air; or poor combustion chamber design.

With reference to combustion chamber design and its influence on the above, in modern technology to improve the anti-detonating characteristics of an engine the chamber is shaped in such a way as uniformly to elevate the propagation velocity of the sheet of flame while at the same time reducing the temperature of unburnt gases in the parts of the chamber which are furthest, thus also obtaining smaller losses to cool the head.

Whatever the causes may be, detonation can occur: before the piston has reached top dead centre; or at top dead centre itself, or even immediately after top dead centre.

Whenever this phenomenon occurs, the combustion of the air-fuel mixture takes place in very short times and is accompanied by a very rapid increase in the pressure and the temperature of the fluid present in the combustion chamber.

Constructively speaking, in order to obtain a satisfactory thermal efficiency, an engine must be made so that is provides a high volumetric compression ratio. This condition contrasts with the absolute necessity of avoiding reaching those conditions which provoke a detonation, so that in order to obtain an acceptable compromise between these opposing requirements, known engines, especially those of the Otto cycle type, have provided various constructive solutions.

Among these solutions, one of the most important is represented by the study of special combustion chamber conformations.

Known solutions of this type have led to the realization of engines having higher volumetric compression ratios, wherein the danger of detonation is not totally eliminated, but only displaced towards higher limit values with respect to prior engines. These solutions have also shown themselves to be complex and expensive to make.

In present-day engines, then, control of the detonation phenomenon is more simply achieved by means of constructional choices involving compression ratios which are lower than certain threshold values considered to be critical.

In modern Otto-cycle engines made for racing competition, special sensors are used, located below the spark plugs or screwed externally at the combustion chamber, with the aim of rapidly identifying and signalling conditions of potential start of detonation, from which ensues an immediate remedial operation involving one or more characteristic parameters—such as for example the flowrate of fuel delivery to the combustion chamber—which, being controlled by an electronic control device, are drastically modified, sharply reducing the engine power, with obviously no resulting power advantage as all the foregoing serves only to protect the engine running, especially in competitions.

Further improvements have been obtained by modifying the composition of the fuels used, especially by developing special chemical substances which, used in the form of additives, help increase the limit of the volumetric compression ratio at which conditions liable to detonation are reached.

In this case, too, although there is a modest increase in pressure and therefore in power, there persist drawbacks of an economic nature connected to the high cost of these additives, and there are even more serious drawbacks connected with significant pollution and subsequent health risks for the public at large.

The aim of the present invention is to resolve the problems connected with the phenomenon of detonation, by providing a reciprocating internal combustion engine which affords a mechanical regulation for controlled and regulated inhibition of detonation, in order to obtain correct and regular engine functioning up to volumetric compression ratios which are decidedly higher than those which can at present be reached by prior art engines.

The invention achieves the above aim by providing an internal combustion engine, made according to the preamble of claim 1, which comprises at least one body mounted rotatably and freely mobile on the connecting rod big end and on the crank pin, on which crank pin said body is mounted eccentrically; by effect of inertia consequent upon the rotation of the crank the body is displaced cyclically rotatingly with respect to the pin and the connecting rod between two operative conditions, in a first of which conditions, corresponding to the piston's reaching Top Dead Centre (TDC) or Bottom Dead Centre (BDC), the body rotates kinematically by an advance angle ($\beta+\alpha$) with respect to the rotation of the connecting rod in relation to the pin, also thanks to the zeroing of the piston speed and the zeroing of its inertia after having reached the maximum point of its reciprocating motion at TDC and BDC, unblocking the eccentric body, in a second of which positions, corresponding to the piston reaching an intermediate zone between TDC and BDC, the body is rotated by an identical angle but in an opposite direction to before, recuperating the advance angle; in correspondence to the angular displacements, the body transmits to the connecting rod an action which superposes the inertia actions of the connecting rod and the piston, and when TDC is reached there is a rapid combined movement of the connecting rod and the crank assembly towards the BDC, so that the conditions likely to cause a detonation of the fuel-air mixture in the combustion chamber by effect of an overpressure generated in the chamber itself are prevented from occurring.

An engine made according to the invention exhibits numerous advantages among which is the ability to operate with various fuels without provoking detonation, such as petrol, fairly heavy fuels and heavyweight fuels, as well as bio-diesel and/or gasoil.

The technical characteristics of the invention, according to the abovementioned aims, are clearly expressed in the contents of the appended claims, and the invention's advantages will clearly result from the following description, with reference to the accompanying figures of the drawings, which represent an embodiment here given purely by way of unrestrictive example, and in which:

Figure 9:
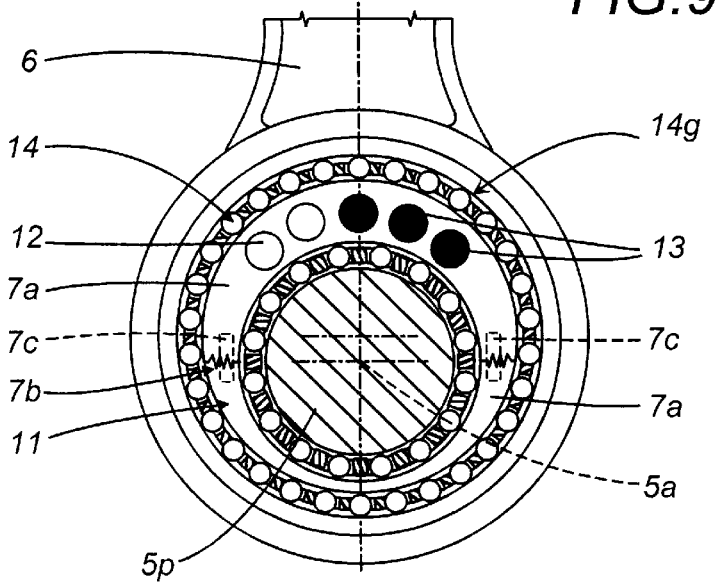
Figure 8:
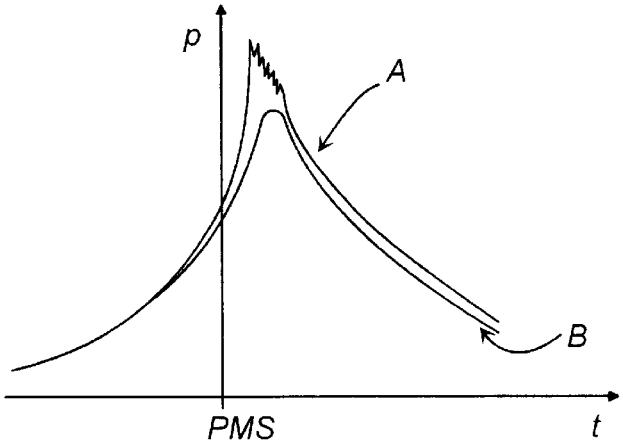

FIGS. 7*a*, 7*b*, 7*c* and 7*d* are views of some details of the engine of the invention;

FIG. 8 is a pressure-time diagram relating to two curves, A and B, which respectively refer to a convention type engine, in which takes place with a detonation (A) and an engine free of detonation (B);

FIG. 9 is an enlarged-scale drawing, in more detail, of an embodiment of the big end of a connecting rod according to the invention.

Figure 2:
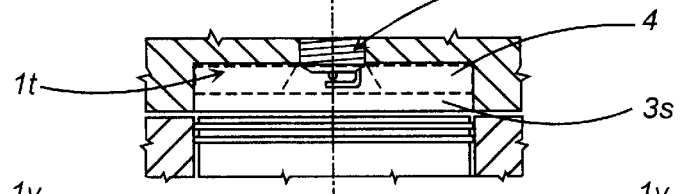
FIGS. 2 and 3 are respectively sections of FIG. 1 made according to lines II—II and III—III.
Figure 3:
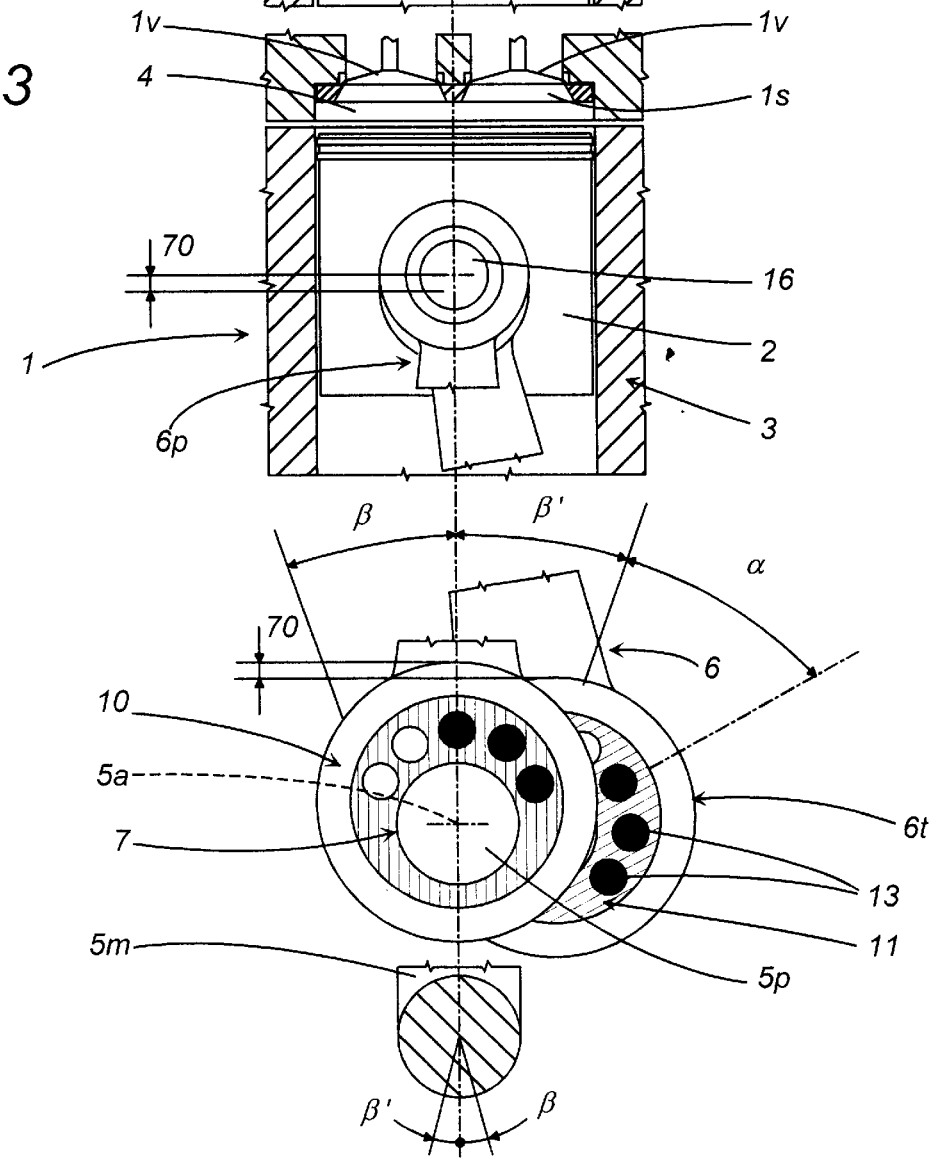

With reference to FIGS. 2 and 3 of the drawings, 1 denotes in its entirety a four-stroke internal-combustion engine of the Otto cycle type, with controlled ignition and essentially comprising a single piston 2 and a crank shaft 5, connected by a connecting rod 6 (also termed "con rod" in the following pages).

The piston 2 is slidably sealedly mounted in a cylinder 3 of the engine 1, internally of which it is alternatingly mobile along a sliding trajectory X, which trajectory is limited by end points known as Top Dead Centre and Bottom Dead Centre.

Figure 1:
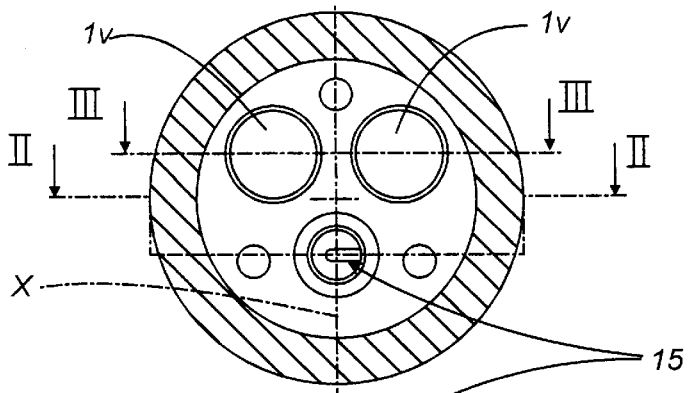
FIG. 1 is a plan view of a reciprocating engine made according to the invention, seen from inside the combustion chamber.
Figure 5:
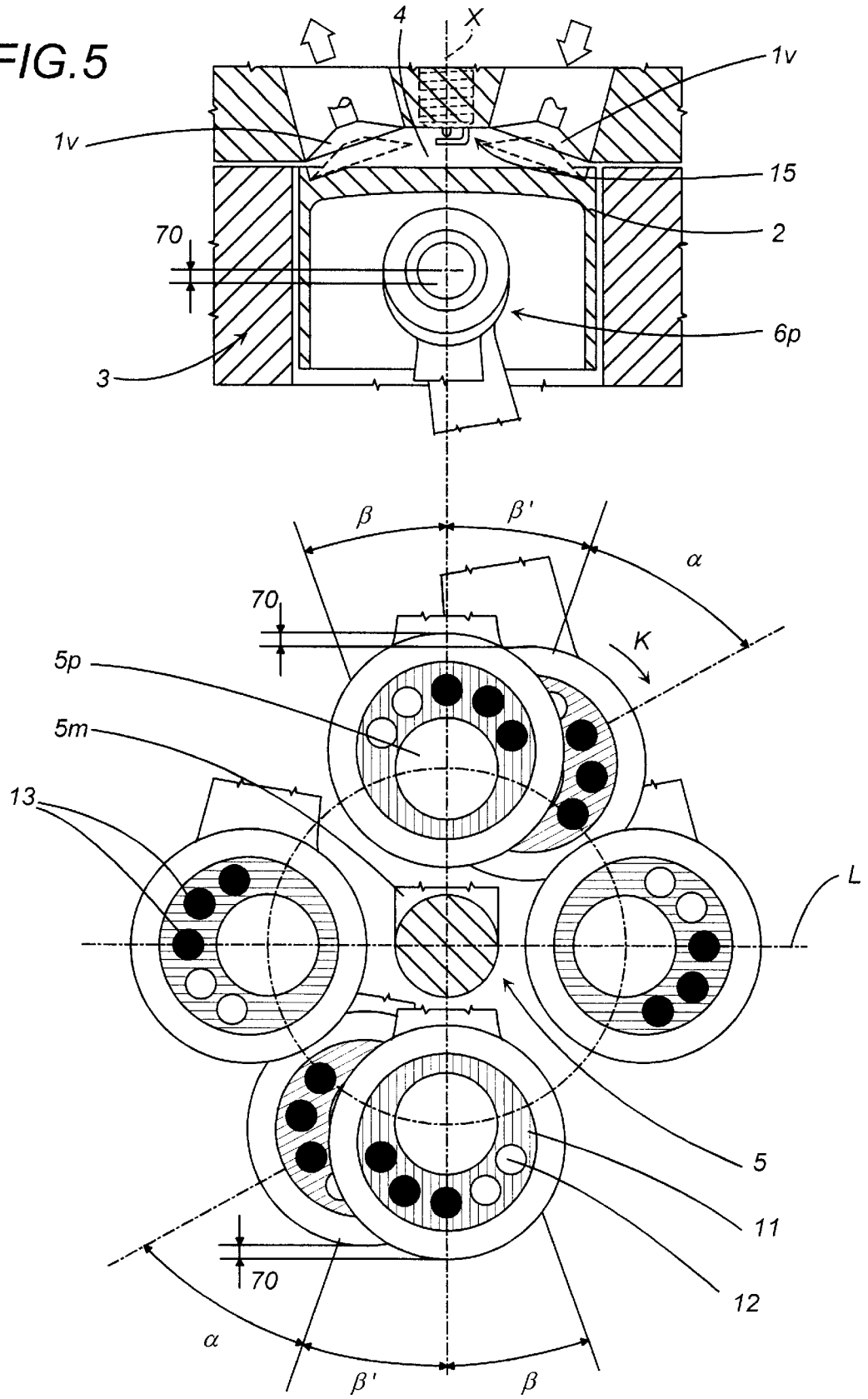
FIG. 5 is an illustration of an alternative embodiment of the engine which schematically shows some significant configurations reached by the eccentric body of the engine during an entire operating cycle.
Figures 6, 7A, 7B, 7C, 7D:
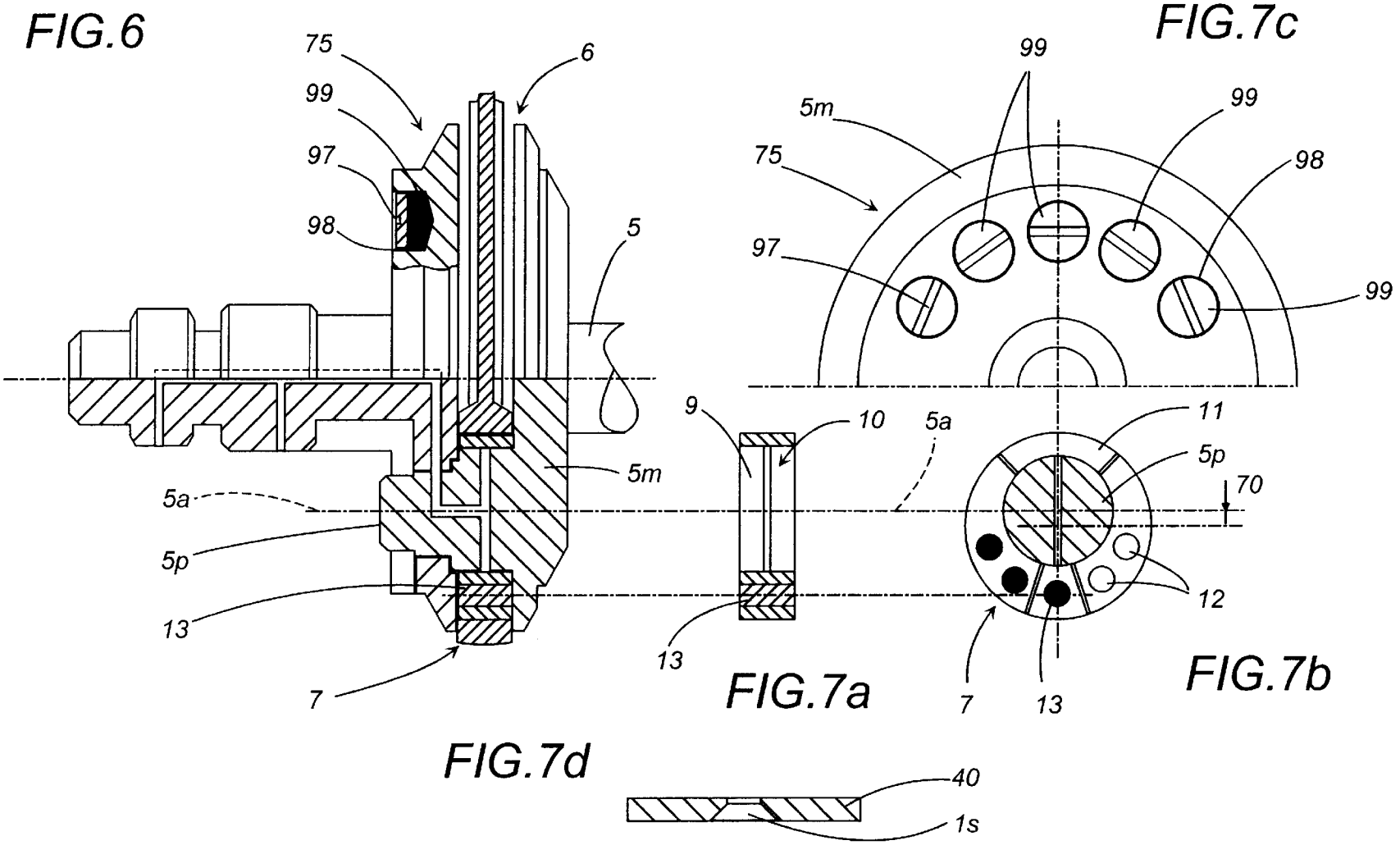
FIG. 6 is a side view in enlarged scale of a detail of FIGS. 3 and 5.

The piston 2, in combination with the cylinder 3, defines a combustion chamber 4, having a mobile wall constituted by a top surface 3*s* of the cylinder 3, which combustion chamber 4, in the non-limiting example of FIG. 1 has a substantially discoid shape, and in the example of FIG. 5 has a roof-type shape. The combustion chamber 4, as is known, follows a working cycle as follows: it receives the fuel-air mixture; then it houses the process of ignition and combustion of the mixture and allows the expansion of the combustion products; finally it expels the combustion products to the outside.

The combustion chamber 4 is provided with an ignition device referenced 15, for igniting a fuel-air mixture, which device is represented by a conventional spark plug mounted on a head 1*t* of the engine 1 on which are also seatings 1*s* for corresponding aspiration and exhaust valves 1*v*.

The crank shaft 5 rotates about supports, not illustrated in the figures, and is provided with at least one crank 5*m* (see FIGS. 6 and 7*c*) which is disc-shaped and provided with balancing bodies 99 housed in cavities 98 and screwed in using a groove 97 therein, said crank 5*m* also bearing a cylindrical pin 5*p* with horizontal axis 5*a*.

The con rod 6 is provided with a small end 6*p*, rotatably connected to a pin 16 borne by the piston 2, and a head or big head 6*t* rotatably connected to pin 5*p* of crank S*m* of the crank shaft 5.

An eccentric body 7 (see FIGS. 5, 7*a*, 7*b*) embodied as a cam element conformed cylindrically and provided with an internal cavity 9 which is off-centre with respect to the outside wall 10 of the body 7, is housed internally of the big end 6*t* of the con rod 6 and is mounted freely rotatably on the con rod 6 and on the pin 5*p* of the crank 5*m*.

In more detail, the cam 7 is provided with an annular body 11 having a variable breadth and provided with a plurality of preferably cylindrical cavities 12 arranged peripherally to the internal cavity 9 and distributed at uniform distances one from another along the annular body 11, equidistant from the centre of the pin 5*p* and oriented with their axes parallel to the central axis 5*a* of the pin 5*p*.

Inserts 13 are removably housed internally of the cavities 12 of the annular body 11, and are generally made of a different material from that used for the cam 7 and are located in predetermined numbers and positions, according to need, as will be better explained hereinbelow. the inserts 13 have a specific mass which is greater than that of the material used to make the cam element 7, and are made for example in tungsten or in a tungsten alloy.

The cam element 7 (see FIG. 9) is provided with bearings 71 made of an antifriction material, such as an aluminium alloyed bronze, and is coupled with the pin 5*p* of the crank 5*m* and the big end 6*t* of the con rod 6 in a relative angular sliding coupling, with hydrodynamic lubrication, about the axis 5*a* of the pin 5*p*.

The cam 7 can be made either in a single body or in two detachable parts 7*a*, reciprocally couplable at joints 7*b* having frontal complementary coupling surfaces, sawtooth-shaped, possibly provided with centering grubs or pins 7*c* (see FIG. 9).

A like configuration made of component parts can be used for the bearings 71, which in FIG. 9 are realised in the shape of two half-shells assembled frontally one to the other.

Figure 4:
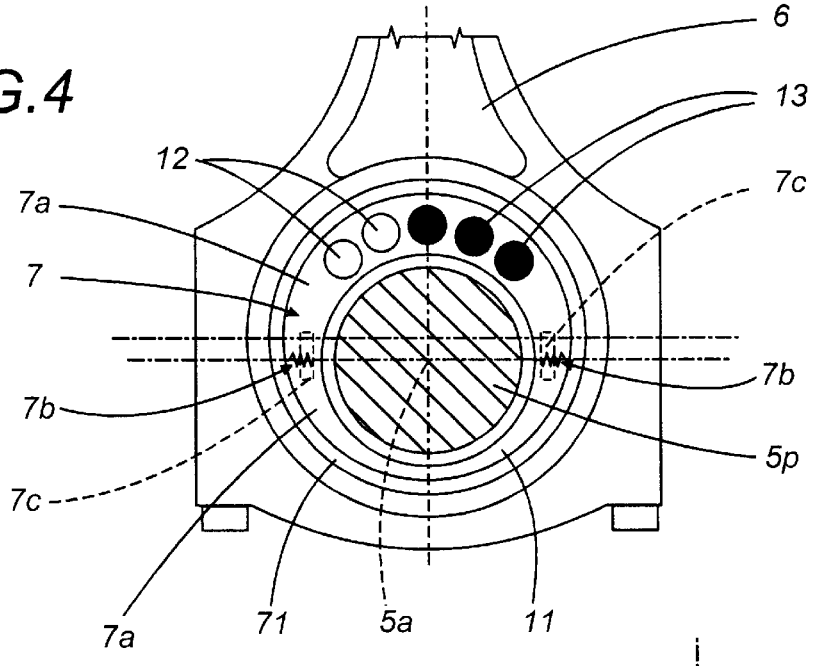
FIG. 4 is an enlarged-scale view of a detail of FIG. 1.

In a further embodiment, illustrated in FIG. 4, the cam 7 is mounted on the pin 5*p* of the crank shaft 5 and on the con rod 6 big end 6*t*, preferably by means of the interposition of revolving bodies 14, such as for example rollers, mounted on a retainer 14*g* and which can revolve in conditions of minimum friction.

Using single or multiple-crown retainers 14*g* divided into two halves (see FIG. 4) enables easy mounting on single-piece crank shafts 5, or in any case crank shafts characterised by a complicated design, and obviously for multiple-section crankshafts e.g. by pins forced with sufficient intereference in the cranks, or in flywheel/cranks 75 (see FIGS. 6 and 7*c*) up to determined powers, or connected with Hirth-type toothed frontal joints or the like, in the case of higher-powered engines.

The annular conformation of the body 11 of the cam 7, the arrangement of the cavities 12, their position about the axis 5*a*, together with the possibility of varying the number and mass of the inserts 13 housed in the cavities 12, all mean that the cam 7 can be configured in various different ways. Thus with a same, constantly-shaped cam 7, it is possible to obtain configurations having overall masses characterised by different mass values and/or total masses which are differently located with respect to the axis 5*a* of the pin 5*p*.

The cam 7, obviously, can be made of a material having high specific mass so as to reduce its size.

In use, the cam 7, due to the effect of inertia consequent upon the rotation of the crank 5*m*, moves cyclically, rotating with respect to the pin 5*p* and the con rod 6 between two operative conditions which, as shown in FIG. 5, alternate at each quarter revolution of the crankshaft 5.

In more detail, corresponding to the reaching of the TDC and BDC, due to its mass eccentricity, the cam 7 tends to rotate freely, advancing the rotation of the con rod 6 relating to the pin 5*p* by an angle equal to $\beta'+\alpha$, which takes in the order of a few tens of thousands of a second, while the con rod 6, by virtue of the rotatory component of its rotating-translating motion, rotates during the same time period by a smaller angle, indicated by $\beta=\beta'$, which is correlated to the number of revolutions of the crankshaft 5.

When the big end 6*t* of con rod 6 reaches a condition corresponding to a position of the piston 2 located at a tract of the downstroke, intermediate to the TDC and BDC, corresponding to the expansion of the gases in the combustion chamber 4, between the big end 6*t* of the con rod 6 and the cam 7 (shown in FIG. 5 in a position displaced by 90° from TDC, moving in the direction of arrow K) there is a relative rotation of the cam 7, the pin 5*p* and the big end 6*t*, in which the cam 7 recuperates, thanks to the effect of centrifugal force, an angle which is identical to the advance angle, but directed oppositely. On this rotation, the centrifuigal force of the crank shaft 5, which keeps the excentric mass constantly turned externalwise, brings the cam 7 into a condition in which the inserts 13 tend to rearrange, newly centering on a line referenced L, which line is substantially orthogonal to the movement line X of the piston 2.

In the continuation of rotation of the crank shaft 5, which brings the crank pin 5*p* from the intermediate position in the expansion stroke as described above, into the BDC position, the cam 7 rotates once more in advance of the big end 6*t* of the connecting rod 6, taking a condition similar to the one which occurred at TDC, with the inserts 13 arranged in an off-centre configuration with respect to the line of advancement X of the piston 2.

During the upward stroke of the piston 2 towards TDC, the process described above is repeated.

Together with the angular displacements of the cam 7, by virtue of the mass of the cam 7 itself, the masses of the inserts 13 and the relative eccentricity with respect to the axis 5*a* of the pin 5*p*, the cam 7 transmits to the con rod 6 an inertia action which adds to the inertia action which can be attributed to the masses of the con rod 6 and the piston 2 and which, when TDC is reached, enable a rapid displacement 70 of the connecting rod 6-crank 5 assembly toward TDC, so as to prevent the creation of the set of conditions in the combustion chamber which will lead to detonation of the fuel-air mixture due to overpressure generated in the chamber itself.

Following the above-described cam angular displacements, during the fuel-air combustion phase, when the pressure of the mixture in the combustion chamber 4 rises sharply until it reaches very high peaks of intensity (see FIG. 8-curve A), the piston 2 and con rod 6, already subject to the expansion thrust, would be equally ready to respond, the response being denoted by the rapid displacement 70, in the line of advancement X direction, translated into a sharp increase in the volume of the combustion chamber 4 (see FIG. 8, curve B), preventing those conditions which might lead to detonation of the mixture.

In other words, the cam 7, by virtue of its own angular displacement in synchrony with the increase in temperature in the combustion chamber, permits the piston 2 to escape the peak of maximum pressure, thus generating a smaller increase in temperature inside the combustion chamber, which is still sufficient however to enable the process of combustion to proceed normally, and completely, up until the end of the chemical reaction optimizing the same.

This characteristic allows e.g. to use a conventional Otto cycle engine, with controlled ignition, up to compression ratio values which are higher than those presently used in Diesel engines, without provoking detonation of the fuel-air mixture.

As the performance of the theoretic Otto cycle principally depends mainly on the compression ratio, a first advantage implied by the above characteristic is that the engines all other conditions being equal, is able to develop much higher power, while it is also able to provide high power and performance even with low octane rating fuel, which is especially susceptible to detonation phenomena.

In other terms, an engine 1 according to the invention enables a controlled-ignition engine to combine many advantages of the Otto engine with many of the advantages of the Diesel engines.

Indeed, the engine 1 of the invention, as regards Otto cycle engines, overcomes the limitations connected with the characteristics of the fuels used for that type of engine, while conserving the advantages of constructional simplicity, compactness and high power/weight ratio.

In relation to spontaneous ignition engines, the engine 1 of the invention provides, at equal power or output, a greater combustion regularity with a consequent reduction in the intensity of the vibrations transmitted to the structure of the engine, resulting in quieter running A further advantage which derives directly from the mechanical control of detonation is connected with the fact that the engine 1 of the invention can function correctly with a plurality of fuels having extremely different characteristics.

The above-mentioned advantages have been clearly evidenced in experiments, by means of a series of tests made on a small displacement internal combustion engine of the Otto cycle type advantageously modified according to the invention.

The single-cylinder aluminium-alloy engine, originally equipped with a carburetor and run with premium grade fuel, was subjected to the following operations:

a—progressive reduction, during tests, of the volume of the original combustion chamber 4, achieved by progressively introducing aluminium-alloy discs 40 (FIG. 7*d*) into the chamber and screwing in them into the top of the head, or by introducing a single such disc having a calibrated breadth, with the aim of optimizing the use of a specific fuel, with flaring seatings in said disc at the valves 1*v* and spark plugs 15, until the volume of the chamber was reduced to below half of the original, corresponding to an increase in the volumetric compression ratio greater than the value currently used in Diesel engines;

b—modification of the resulting combustion chamber 4 being regular in shape and compact (illustrated in FIG. 3) and being such as to give, during combustion, a regular and correct progress of the sheet of flame originating from the spark plug 15;

c—modification of the diameter of the carburetor jet, in order to enable the jet to spray a plurality of different fuels, ranging from lightweight petrols to semi-heavyweight and heavyweight fuels, such as for example diesels of the type known as bio-diesel (obtained by esterification of vegetable oils such as sunflower seed oil, rape oil—with methanol or ethanol) and conventional type fuels. When the more heavyweight fuels were used, the engine was pre-heated by running with lighter weight high-volatility fuels, and was then maintained at a high temperature during running with heavyweight fuels;

d—modification of the electrical regulation device regulating the originally-mounted ignition advance, in order that for the purposes of the experiments it could be manually regulated, with the aim of obtaining a variable modulation of the regulation conditions from start-up up until the various rotation speeds, according to the type of fuel or the different types of fuel mixtures used.

In a further embodiment of the prototype engine 1 as modified above, a pre-heating of the heavy fuels can be achieved alternatively to what is described above in c) by inserting one or more glow plugs or thermal plugs into the passage connecting the carburetor to the engine 1 aspiration duct. The glow plugs are apt to heat and enable the initial vaporisation of the fuel-air mixture as well as providing the conditions for maintaining the following combustion process of the heavy fuels.

A further improvement can be obtained by substituting the carburetor with in direct or, even better, direct injection, combined with an electronic regulation of the electrical advance. In this case regulation of ignition, both of the advance and the duration of the injection, can be advantageously programmed according to the number of crank shaft revolutions and the fuel type used.

The prototype of the engine 1 modified as described above was subjected to various different testing procedures, using the following fuels:

premium grade petrol (as originally prescribed by the manufacturer);

regular petrol;

regular petrol/ethyl alcohol (mixtures at various percentages);

regular petrol/methyl alcohol (mixtures at various percentages);

regular petrol/diesel fuel (mixtures at various percentages);

diesel fuel (including diesels mechanically emulsified with water, at various percentages):

bio-diesel (including mixtures with water at various percentages, inasmuch they are easily emulsified, as biodiesel is chemically obtained by esterification of vegetable oils, using methanol or ethanol, with zero acidity).

The engine 1 prototype made according to the invention, though made entirely of aluminium and in dimensions suited to the force and vibrations specific to the Otto cycle, came through all the test cycles, both when lightweight fuels were used and when heavyweight fuels were used, with a compression ratio above that necessary for an engine functioning normally in a Diesel cycle. No excessive temperatures were noted, due to the elimination of power peaks, thanks to the system of mechanical regulation which is a characteristic of the present invention.

This confirms that the engine of the invention, though operating with high compression ratios, is structurally less stressed than conventional engines, as it is not subjected to power peaks, nor to even transient knocking, so that there is a power/weight ratio that makes the engine suitable not only for motor vehicles but also for water-borne and air-borne crafts.

The above-described invention thus fully achieves the set aims, combining positively advantageous characteristics of both Otto and Diesel engines. Furthermore, as it enables modifications to be made to the volumetric and thermodynamic efficiency of the engine, by operating on the compression and combustion, the invention leads to reduction of unburnt fuel emission and enables a wide range of fuels different and simplified, including low-octane fuels, to be used with a same engine, developing all the same an almost identical calorific power, while removing non-ecological hydrocarbons (benzene and other polluting substances, etc.) with simple processing cycles which also lead to costs savings and a greater added value.

Similar considerations can be made with reference to low-cetane diesel oils, since the engine 1 of the invention can use diesel oil with lower cetane ratings than diesel oil for motor vehicles.

It is important to mention that many internal combustion engines currently in circulation and commerce could be transformed either by the manufacturers themselves to equip the invention, or by using special "kits" and substituting the conventional connecting rod with the connecting rod with cam 7 incorporated, modifying the head and/or replacing the piston 2 with another, differently-conformed one, in order rationally and advantageously to reduce the volume of the combustion chamber 4.

Many modifications and variants can be brought to the invention, all said modifications and variants being within the scope of the inventive concept. Furthermore, all details can be substituted with technically equivalent elements.

I claim:

1. A reciprocating internal combustion engine comprising: a piston (2) and a cylinder (3), the piston (2) being internally slidably and sealedly mounted to the cylinder (3) and being reciprocally mobile between two dead centre points, a Top Dead Centre (TDC) and a Bottom Dead Centre (BDC); a combustion chamber (4) delimited by the piston (2) and the cylinder (3); a crankshaft (5) provided with at least one crank **(5*m*) pin (5*p*); a connecting rod (6) having a small end (6*p*) rotatably connected to the piston (2) and a big end (6*t*) rotatably connected to the pin (5*p*) of the crank (5*m*) of the crank shaft (5), characterised in that it comprises at least one body (7), mounted, rotatably and freely mobile on the big end (6*t*) of the connecting rod (6) and rotatably, freely mobile and eccentrically mounted on the pin (5*p*) of the crank (5*m*), which body (7) by effect of inertia consequent to a rotation of the crank (5*m*), moves cyclically rotatingly with respect to the pin (5*p*) and the connecting rod (6) between two operative positions, in a first of which, corresponding to the piston (2) reaching the Top Dead Centre or the Bottom Dead Centre, the body (7) is rotated by an advance angle ($\alpha$) with respect to a rotation of the connecting rod (6) in relation to said pin (5*p*), and in a second of which positions, corresponding to the piston (2) reaching an intermediate tract between said Top Dead Centre and Bottom Dead Centre, the body (7) being rotated by an identical but oppositely-directed angle ($\beta'+\alpha$,), recuperating the advance angle ($\alpha$); the body (7) transmitting, in correspondence with angular displacements, an action to the connecting rod (6) which adds to the inertia actions of the connecting rod (6) and the piston (2), and which in correspondence with reaching Top Dead Centre enables a rapid displacement (70) of the connecting rod (6)-crank (5*m*) assembly towards the Bottom Dead Centre, so as to prevent a series of conditions from occurring in the combustion chamber (4) which could lead to detonation of a fuel-air mixture due to an effect of an overpressure generated in said combustion chamber (4)**.

2. The engine of claim 1, characterised in that the body is a cylindrically shaped cam (7), having an internal cavity (9) which is offcentre with respect to the cam periphery (10), said cam being rotatably mounted on the pin **(5*p*) of the crank (5*m*)**.

3. The engine of claim 2, characterised in that the cam (7) is provided with at least one cavity (12) arranged peripherally of said internal cavity (9).

4. The engine of claim 3, characterised in that said at least one cavity (12) or each cavity (12) of the cam (7) is cylindrically conformed.

5. The engine of claim 3, characterised in that the cam (7) is provided with at least two cavities (12), which at least two cavities are equidistant from a central axis **(5*a*) of the pin (5*p*)**.

6. The engine of claim 5, characterised in that it comprises inserts (13) made of a material having a specific mass which is different from a specific mass of a material used to realise the cam (7), which inserts (13) are housed internally of said at least one cavity (12) of the cam (7).

7. The engine of claim 6, characterised in that said inserts (13) are removably housed in said at least one cavity (12) of the cam (7).

8. The engine of claim 1, characterised in that it comprises revolving bodies (14) arranged between the cam (7) and the pin **(5*p*) of the crank shaft (5)**.

9. The engine of claim 1, characterised in that it allows the combustion of a plurality of fuels, different one from another.

10. The engine of claim 9, characterised in that it comprises means (15) for controlled ignition of the fuel-air mixture, which means are active at least during a transient period of heating of the engine (1) up until a working temperature is reached therein.

11. The engine of claim 9, characterised in that at least one of said fuels has a low octane rating.

12. The engine of claim 9, characterised in that at least one of said fuels has a low cetane rating.

13. The engine of claim 11, characterised in that the octane rating is lower than an octane rating of normal and commercially-available petrols free of additives.

14. The engine of claim 12, characterised in that the cetane rating is lower than a cetane rating of motor vehicle diesel oils.

15. The engine of claim 2, characterised in that said cam (7) is made in at least two disassemblable parts **(7*a*)**.

* * * * *